US010569998B2

(12) United States Patent
Coccaro

(10) Patent No.: US 10,569,998 B2
(45) Date of Patent: Feb. 25, 2020

(54) PNEUMATIC JACK WITH DOWNWARD PRESSING BLADDER

(71) Applicant: Albert V. Coccaro, Mt. Kisco, NY (US)

(72) Inventor: Albert V. Coccaro, Mt. Kisco, NY (US)

( * ) Notice: Subject to any disclaimer, the term of this patent is extended or adjusted under 35 U.S.C. 154(b) by 193 days.

(21) Appl. No.: 15/866,023

(22) Filed: Jan. 9, 2018

(65) Prior Publication Data

US 2019/0210848 A1 Jul. 11, 2019

(51) Int. Cl.
*B66F 3/35* (2006.01)
*B66F 5/04* (2006.01)

(52) U.S. Cl.
CPC . *B66F 3/35* (2013.01); *B66F 5/04* (2013.01)

(58) Field of Classification Search
CPC ..... B66F 5/04; B66F 3/35; B66F 3/40; B66F 15/00
See application file for complete search history.

(56) References Cited

U.S. PATENT DOCUMENTS 658,939 A * 10/1900 Benton ..... B66F 15/00 254/129
2,054,555 A * 9/1936 Cochin ..... B66F 5/04 254/2 B
2,955,801 A * 10/1960 Ploug, Jr. ..... B66F 3/35 254/2 B
3,379,411 A * 4/1968 VanDerjagt ..... B66F 3/35 254/93 R
3,521,861 A * 7/1970 Freudenthal ..... B66F 3/35 254/93 L
4,762,298 A 8/1988 Wood
4,874,285 A * 10/1989 Bubik ..... B60P 3/125 414/563
5,354,167 A 10/1994 Cullum et al.
5,471,693 A * 12/1995 Hodges ..... B65G 69/2823 14/71.3
6,302,378 B1 * 10/2001 Koch ..... B66F 15/00 254/131
6,360,393 B1 * 3/2002 Fritz ..... B65G 69/2817 14/69.5

(Continued)

FOREIGN PATENT DOCUMENTS

DE 202004009008 U1 9/2004
FR 2272021 A2 12/1975

(Continued)

OTHER PUBLICATIONS

Zendex Tool Corporation, RakJak: Pneumatic Jacks Designed Tough and Built to Last, Brochure, 2006, Zendex Tool Corporation, Danbury, CT, USA.

*Primary Examiner* — Tyrone V Hall, Jr.
(74) *Attorney, Agent, or Firm* — Law Offices of Michael L. Wise, LLC

(57) ABSTRACT

A pneumatic jack includes a body, a lifting arm, and a bladder. Inflating the bladder applies downward pressure on a proximal end of the lifting arm and raises a distal end of the lifting arm. Subsequently deflating the bladder has the opposite effect. A mounting block at the distal end of the lifting arm allows the pneumatic jack to be used to raise and lower an object such as an automobile through inflation and deflation of the bladder.

18 Claims, 12 Drawing Sheets

(56) References Cited

U.S. PATENT DOCUMENTS

| | | | | |
|---|---|---|---|---|
| 6,497,399 | B1 * | 12/2002 | Nelson | B66F 15/00 254/120 |
| 6,789,785 | B2 * | 9/2004 | Hung | B66F 5/04 254/8 B |
| 6,913,287 | B2 * | 7/2005 | Leitner | B62M 27/02 180/190 |
| 9,162,857 | B2 | 10/2015 | Coccaro | |
| 2007/0120102 | A1 * | 5/2007 | Kaplenski | B66F 3/35 254/93 HP |
| 2013/0187108 | A1 * | 7/2013 | Coccaro | B66F 3/35 254/93 R |

FOREIGN PATENT DOCUMENTS

| | | | |
|---|---|---|---|
| JP | 49064959 | U | 6/1974 |
| JP | 62038396 | U | 3/1987 |
| JP | H0569077 | U | 9/1993 |

* cited by examiner

PNEUMATIC JACK WITH DOWNWARD PRESSING BLADDER

FIELD OF THE INVENTION

The present invention relates generally to apparatus for applying a lifting force to a stationary object, and, more particularly, to pneumatic jacks.

BACKGROUND OF THE INVENTION

Pneumatic jacks are frequently found in automobile repair facilities. Many such jacks utilize air springs (also called "air lift bags," "air struts," and "air bellows") to create a lifting force. An air spring may comprise a reinforced bladder. Inflation of the bladder by compressed air causes the air spring to expand. A jack pad contacts the vehicle and allows the air spring to raise the vehicle. Pneumatic jacks with air springs may have lifting capacities of three tons or more.

Air springs tend to gradually lose their lifting force as they are inflated, which may inversely impact the lifting capacity of an air-spring-based jack. At the same time, many air-spring-based jacks suffer from the inability to be lowered sufficiently to be used to lift vehicles that sit relatively low to the ground (i.e., low profile vehicles). There is, as a result, a need for alternative air-spring-based pneumatic jack designs that address these shortcomings while still providing ample lifting capacities and maximum lifting heights.

SUMMARY OF THE INVENTION

Embodiments of the present invention address the above-identified needs by providing pneumatic jack designs operative to raise vehicles and other objects utilizing an inflatable bladder.

Aspects of the invention are directed to an apparatus comprising a jack body, a lifting arm, a lower mount, an upper mount, a bladder, and a plurality of wheels. The lifting arm is pivotally coupled to the jack body. At the same time, the lower mount is pivotally coupled to a proximal end of the lifting arm, while the upper mount is attached to the jack body. The bladder is disposed between the lower mount and the upper mount, and the plurality of wheels are attached to the jack body. With the plurality of wheels resting on a horizontal surface, the upper mount is positioned higher than the lower mount, and inflating the bladder applies downward pressure on the lower mount, causing the lower mount to move downward. Deflating the bladder while it is at least partially inflated removes the downward pressure on the lower mount, allowing the lower mount to move upward. Downward movement of the lower mount lowers the proximal end of the lifting arm and raises the distal end of the lifting arm. Upward movement of the lower mount raises the proximal end of the lifting arm and lowers the distal end of the lifting arm.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
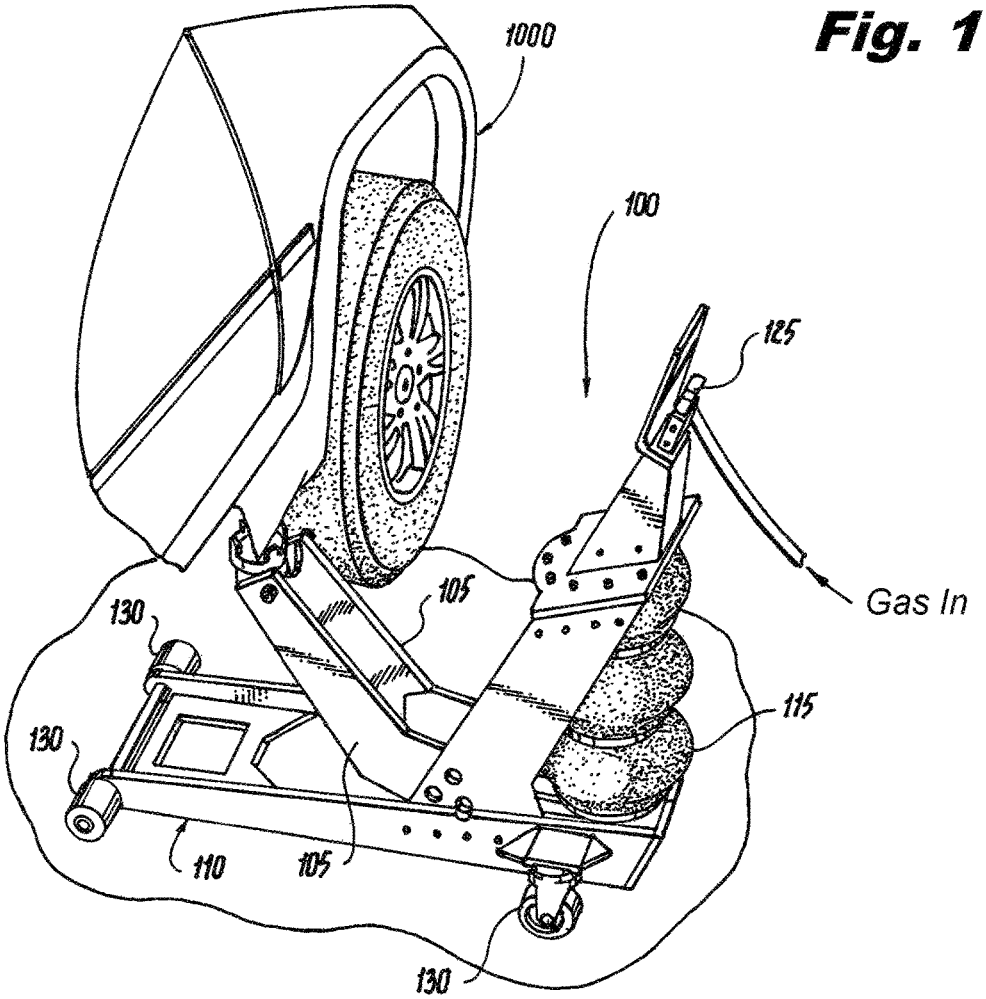
FIG. 1 shows a perspective view of a pneumatic jack in accordance with an illustrative embodiment of the invention while the pneumatic jack is lifting an automobile.

The present invention will be described with reference to illustrative embodiments. For this reason, numerous modifications can be made to these embodiments and the results will still come within the scope of the invention. No limitations with respect to the specific embodiments described herein are intended or should be inferred.

As used herein and in the appended claims, "substantially parallel" means parallel within 20 degrees. A "substantially constant orientation" relative to something else is an orientation that does not vary by more than 20 degrees relative to the something else. A "sleeve" has a hollow cylindrical shape. Finally, the directions "upward," "downward," "higher," "lower," "above," and "below" are referenced to the manner in which the apparatus is depicted in the drawings, namely an orientation that the apparatus would take with its wheels resting on a horizontal surface.

Figure 2:
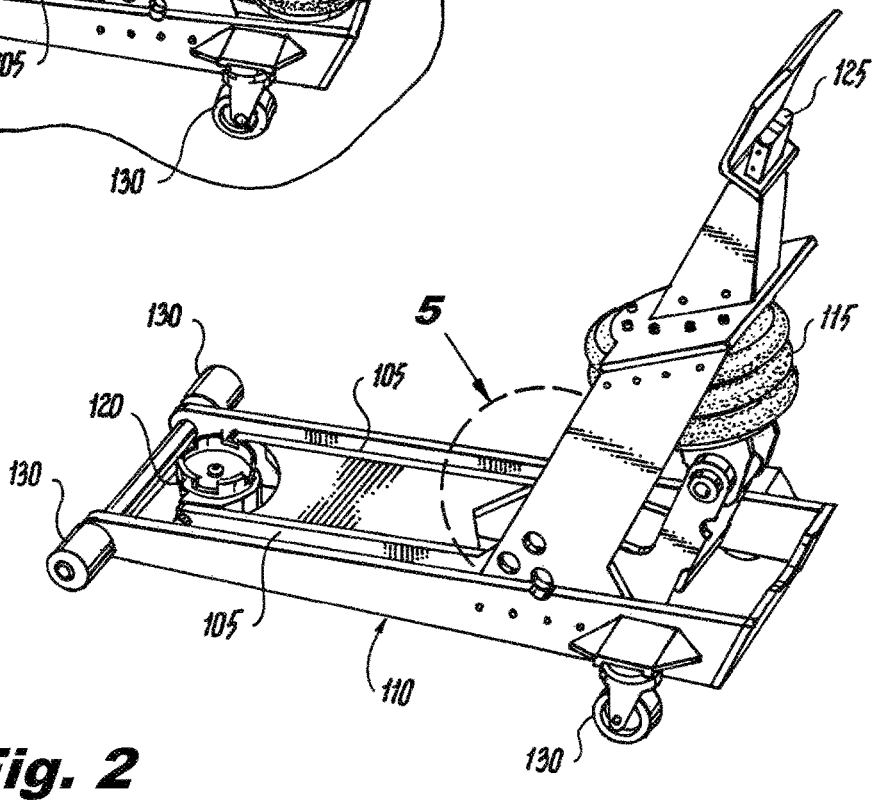
FIG. 2 shows another perspective view of the FIG. 1 pneumatic jack with the pneumatic jack lowered.

FIGS. 1 and 2 show perspective views of a pneumatic jack 100 in accordance with a first illustrative embodiment of the invention. In FIG. 1, the pneumatic jack 100 is in a raised state and is being used to lift an automobile 1000, while, in FIG. 2, the pneumatic jack 100 is in a lowered state. The pneumatic jack 100 includes a pair of lifting arms 105 that are pivotally coupled to a jack body 110. The pair of lifting arms 105 interface with a bladder 115 at their proximal ends (i.e., the ends to the right in FIGS. 1 and 2) and with a jack pad 120 at their distal ends (i.e., the ends to the left in FIGS. 1 and 2). The pivoting of the arms relative to the jack body 110 is controlled by inflation of the bladder 115, which is commanded through an inflation control valve 125 available to the user. Inflating the bladder 115 places a downward pressure on the proximal ends of the pair of lifting arms 105, lowering these proximal ends and, in a lever-like manner, raising the distal ends of the pair of lifting arms 105 with the jack pad 120. Fully inflated, the bladder 115 provides the condition shown in FIG. 1. Subsequently, deflating the bladder 115 removes the downward pressure on the proximal ends of the pair of lifting arms 105, and allows the proximal ends to rise while the distal ends of the pair of lifting arms 105 and the jack pad 120 gradually lower. Fully deflated, the bladder 115 provides the condition shown in FIG. 2. Raising the automobile 1000 with the pneumatic jack 100 is therefore as easy as, connecting the pneumatic jack 100 to a source of compressed air, placing the jack pad 120 under the automobile 1000 at the point of lift, and actuating the inflation control valve 125 to inflate the bladder 115. Lowering the automobile 1000 involves releasing the air from the bladder 115 to deflate the bladder 115, allowing the jack pad 120 to lower. Wheels 130 on the pneumatic jack 100 allow it to be easily moved.

Figure 3:
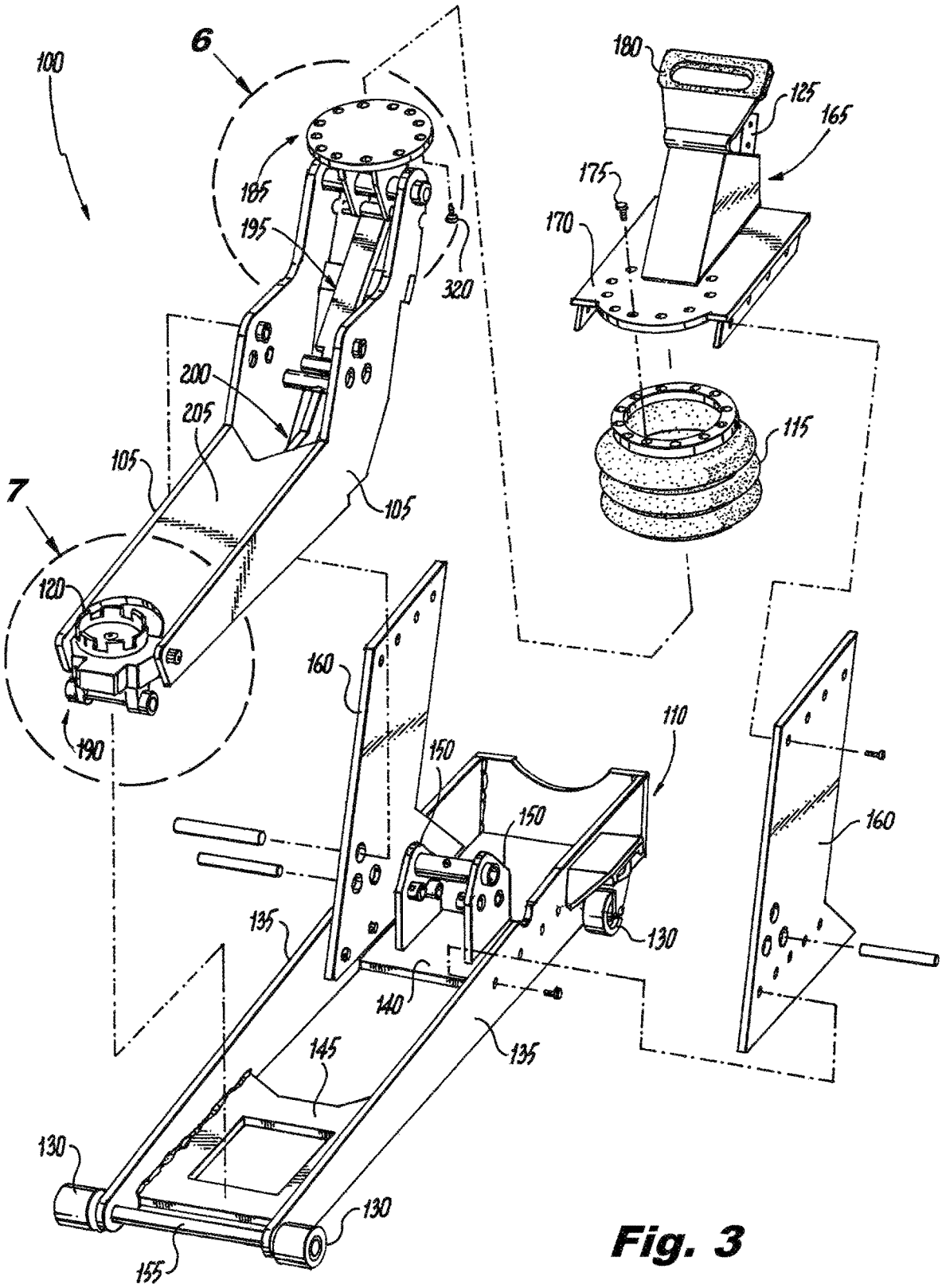
FIG. 3 shows an exploded perspective view of the FIG. 1 pneumatic jack.

FIGS. 3-7 provide additional structural details of the illustrative pneumatic jack 100. FIG. 3 starts by showing an exploded perspective view of aspects of the entire device. In FIG. 3, the proximal direction is going into the drawing, while the distal direction is coming out of the drawing.

The jack body 110 includes a pair of lower sidewalls 135. A first lower plate 140 and a second lower plate 145 span between the pair of lower sidewalls 135, and a pair of internal sidewalls 150 project upward from the first lower plate 140. The forward wheels 130 are mounted on a common axle 155 that passes through the pair of lower sidewalls 135, while the rear wheels 130 are in the form of casters that are mounted to projections from the pair of lower sidewalls 135.

A pair of upper sidewalls 160 project upward from the pair of lower sidewalls 135. At the top of the upper sidewalls, a control portion 165 is attached, which includes an upper mount 170 for the bladder 115. The top of the bladder 115 is mounted to the upper mount 170 via upper bolts 175. The inflation control valve 125 and a handle 180 for the pneumatic jack 100 are also part of the control portion 165.

Still referring to FIG. 3, a lower mount 185 is pivotally coupled to the proximal ends of the pair of lifting arms 105, while a mounting block 190 and the jack pad 120 are pivotally coupled to the distal ends of the pair of lifting arms 105. The lower mount 185 is attached to a bottom of the bladder 115, causing the bladder 115 to be disposed between the lower mount 185 and the upper mount 170. A rearward stabilizing member 195 spans between the pair of internal sidewalls 150 (and, by extension, the jack body 110) and the lower mount 185, and a forward stabilizing member 200 spans between the pair of internal sidewalls 150 and the mounting block 190. A top plate 205 spans between the pair of lifting arms 105.

Figure 4:
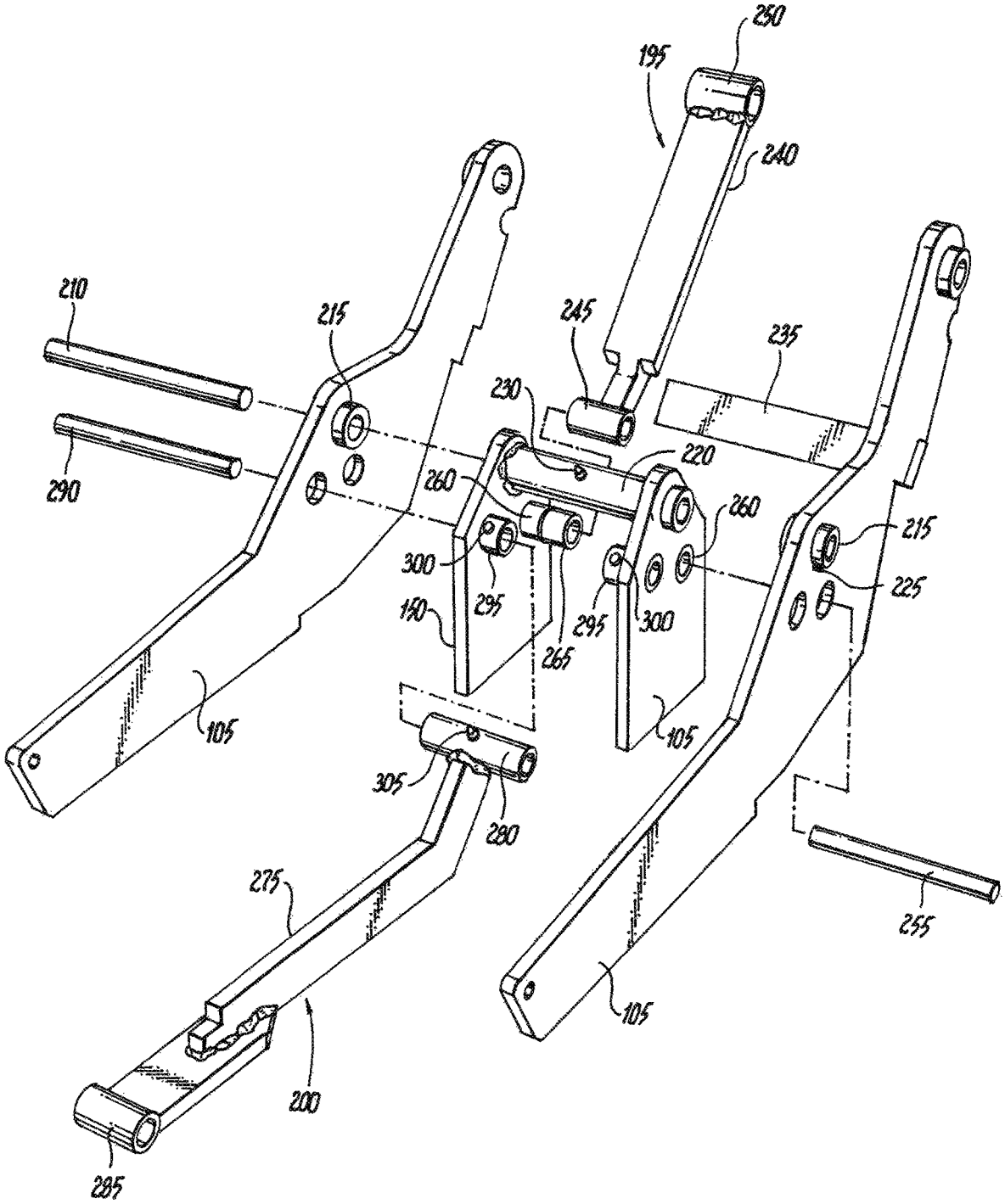
FIGS. 4 and 5 show exploded and intact perspective views, respectively, of the FIG. 1 pneumatic jack proximate to the pair of internal sidewalls.
Figure 5:
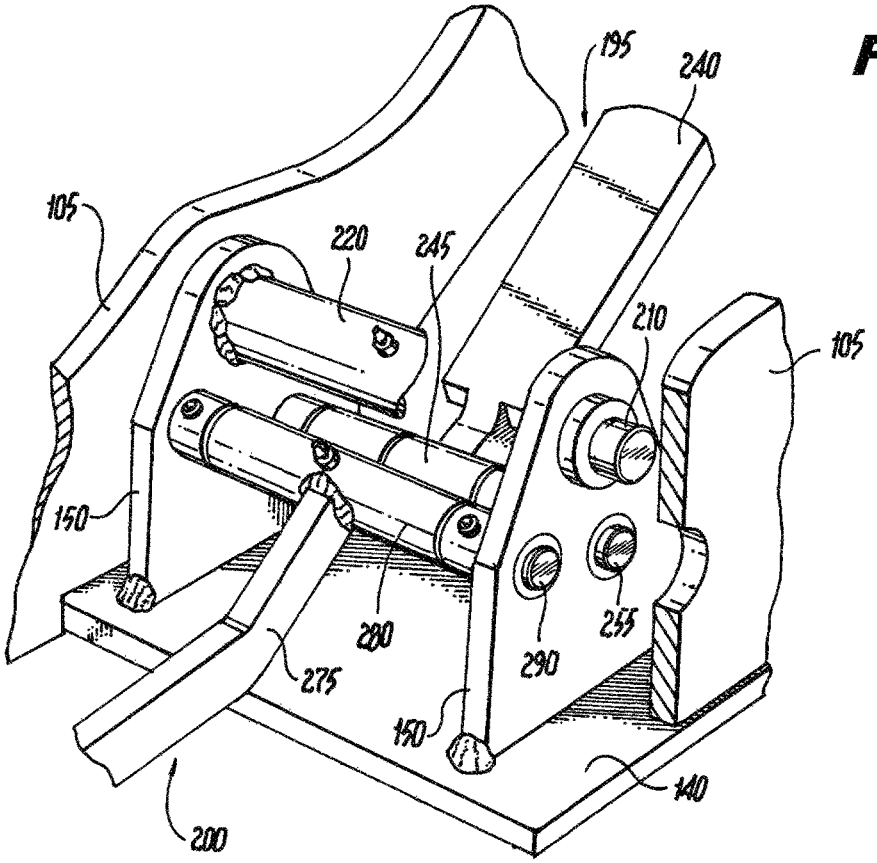

The pair of internal sidewalls 150 of the jack body 110 provide a pivotal mounting platform for the pair of lifting arms 105, the rearward stabilizing member 195, and the forward stabilizing member 200. FIGS. 4 and 5 show details of this region of the pneumatic jack 100, with FIG. 4 providing an exploded perspective view, and FIG. 5 providing and intact perspective view.

The pair of lifting arms 105 are substantially parallel to one another, and are pivotally coupled to the internal sidewalls via a first pin 210 that passes through a pair of first sleeves 215 that each penetrate a respective one of the pair of lifting arms 105, and a second sleeve 220 that passes through and between the pair of internal sidewalls 150. The pair of first sleeves 215 and the second sleeve 220, like all "sleeves" described herein, are hollow cylindrical in shape per the explicit definition set forth above. First set screws 225 in the pair of first sleeves 215 immobilize the first pin 210 relative to the pair of lifting arms 105, and a first grease fitting 230 allows grease to be placed between the second sleeve 220 and the first pin 210. As the pair of lifting arms 105 pivot relative to the jack body 110, the first pin 210 rotates inside the second sleeve 220. In this manner, the first pin 210 forms the fulcrum for the pair of lifting arms 105. A reinforcing bar 235 spans between the pair of lifting arms 105.

The rearward stabilizing member 195 and the forward stabilizing member 200 are likewise pivotally mounted to the jack body 110 via the pair of internal sidewalls 150, as detailed in FIG. 4. The rearward stabilizing member 195 comprises a rearward bar 240 that spans between a third sleeve 245 and a fourth sleeve 250. The third sleeve 245 is pivotally mounted to the pair of internal sidewalls 150 utilizing a second pin 255 that passes through a pair of fifth sleeves 260 that each pass through a respective one of the pair of internal sidewalls 150, a pair of sixth sleeves 265, and the third sleeve 245. Second set screws in the pair of fifth sleeves 260 (facing away in FIG. 4 and therefore not visible) impair the rotation of the second pin 255.

Similarly, the forward stabilizing member 200 comprises a forward bar 275 that spans between a seventh sleeve 280 and an eighth sleeve 285. The forward stabilizing member 200 is pivotally mounted to the pair of internal sidewalls 150 utilizing a third pin 290 that passes through a pair of ninth sleeves 295 that each pass through a respective one of the pair of internal sidewalls 150, and the seventh sleeve 280. Here, third set screws 300 in the pair of ninth sleeves 295 impair rotation of the third pin 290. A second grease fitting 305 allows grease to be placed between the seventh sleeve 280 and the third pin 290.

Figure 6:
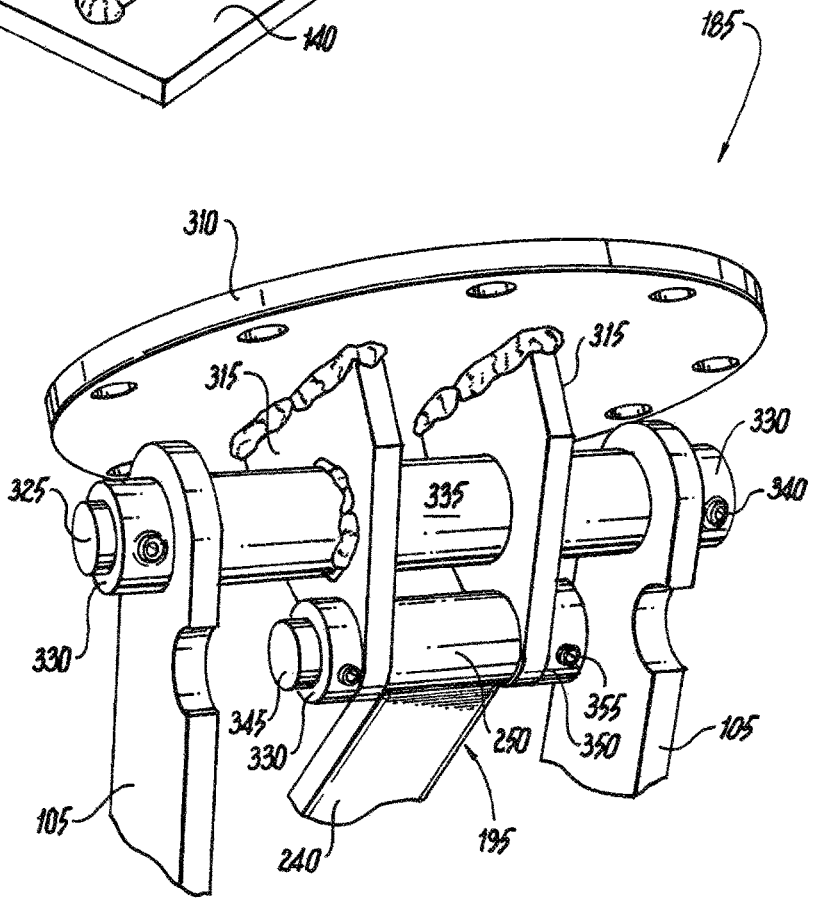
FIG. 6 shows a perspective view of the FIG. 1 pneumatic jack proximate to the lower mount.

Details of the pneumatic jack 100 proximate to the lower mount 185 are shown in perspective in FIG. 6. The lower mount 185 defines a lower platter 310 with a pair of first downward projecting sidewalls 315. The lower platter 310 is shaped so as to easily attach to the bottom of the bladder 115 using lower bolts 320 (see FIG. 3), placing the bladder 115 between the upper mount 170 and the lower mount 185. At the same time, the lower mount 185 is at least partially disposed between the pair of lifting arms 105. Both the proximal ends of the pair of lifting arms 105 and the rearward stabilizing member 195 are pivotally coupled to the lower mount 185. The pair of lifting arms 105 pivotally couple to the lower mount 185 via a fourth pin 325 that passes through a pair of tenth sleeves 330 positioned on the outside of corresponding holes in the pair of lifting arms 105, and an eleventh sleeve 335 that passes through and between the pair of first downward projecting sidewalls 315. Fourth set screws 340 fixate the fourth pin 325 relative to the pair of lifting arms 105. The rearward stabilizing member 195 is pivotally coupled to the lower mount 185 in a similar manner, utilizing a fifth pin 345 that passes through a pair of twelfth sleeves 350 on the outside of corresponding holes in the pair of first downward projecting sidewalls 315, and the fourth sleeve 250 of the rearward stabilizing member 195. Fifth set screws 355 fixate the fifth pin 345 relative to the pair of first downward projecting sidewalls 315.

Figure 7:
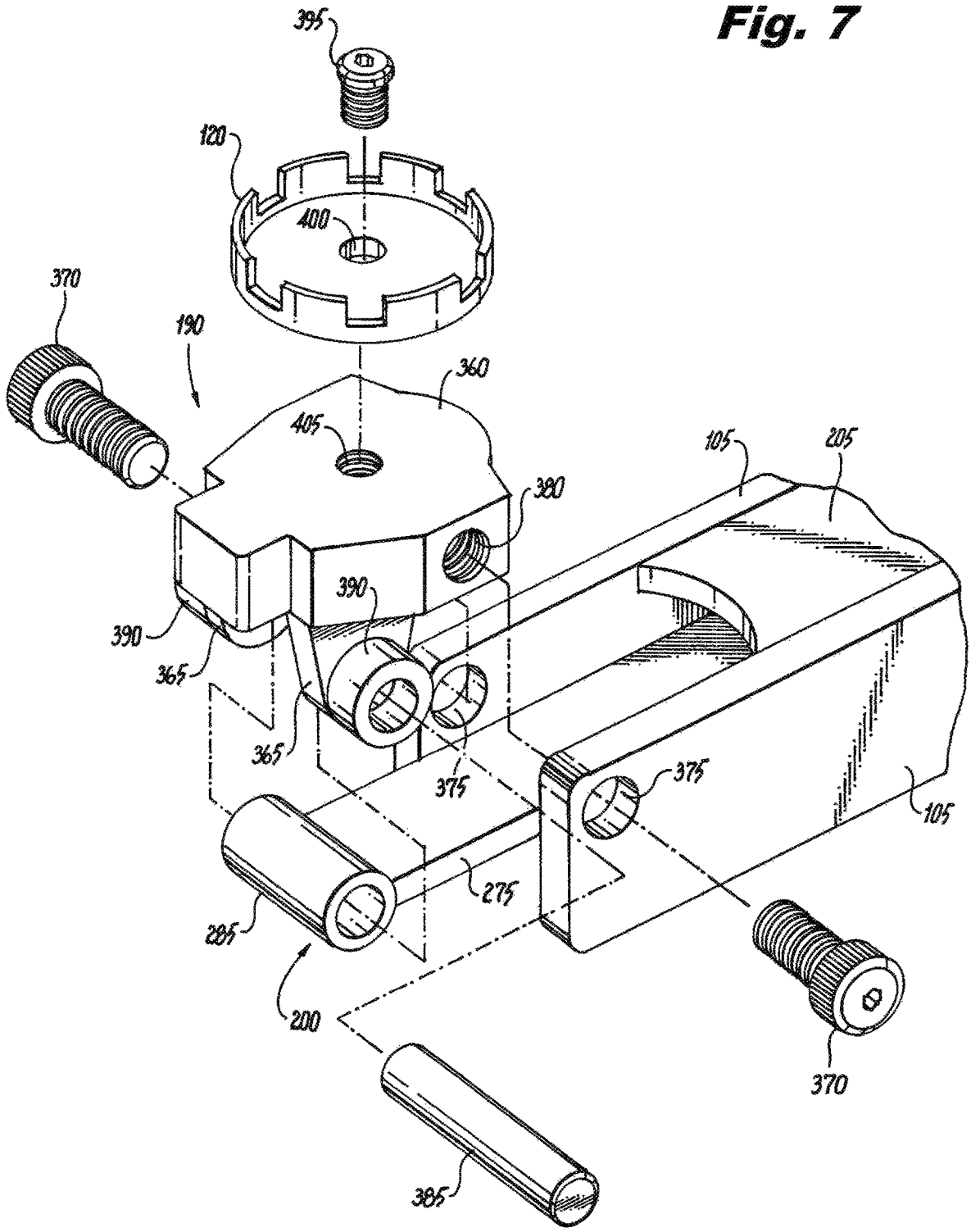
FIG. 7 shows an exploded perspective view of the FIG. 1 pneumatic jack proximate to the mounting block.

Finally, FIG. 7 shows an exploded view of the region of the illustrative pneumatic jack 100 proximate to the mounting block 190 and the jack pad 120. The mounting block 190 describes a platform 360 with a pair of second downward projecting sidewalls 365. The mounting block 190 is pivotally mounted to the distal ends of the pair of lifting arms 105 by two lateral bolts 370 that pass through smooth-bored holes 375 in the pair of lifting arms 105 and corresponding lateral threaded receiving holes 380 in the mounting block 190. The mounting block 190 is thereby partially disposed between the pair of lifting arms 105. At the same time, the forward stabilizing member 200 is pivotally mounted to the mounting block 190 via a sixth pin 385 that passes through pair of thirteenth sleeves 390 positioned outside corresponding holes in the pair of second downward projecting sidewalls 365, and the eighth sleeve 285 of the forward stabilizing member 200. The jack pad 120 is mounted on top of the platform 360 of the mounting block 190 via a vertical bolt 395 that passes through an opening 400 in the jack pad 120 and into a vertical threaded receiving hole 405 in the platform 360. The vertical bolt 395 can be easily removed and replaced so as to swap out the jack pad 120 when desired.

Once the novel aspects of the invention are understood from the teachings herein, embodiments of the invention may, to a large extent, be manufactured utilizing conventional forming and fabrication techniques. Elements such as the pair of lifting arms 105, the jack body 110, the jack pad 120, the control portion 165, the upper mount 170, the lower mount 185, the mounting block 190, and the forward and rearward stabilizing members 195, 200, for example, are preferably (but not necessarily) formed from one or more metals such as steel, aluminum, or brass. These elements may be formed utilizing conventional metal fabrication techniques such as machining, stamping, forging, casting, cutting (manual and/or under computer numerical control (CNC)), bending, and welding. These metalworking techniques and others will be familiar to one having ordinary skill in the fabrication arts. Moreover, metalworking techniques are described in readily available references including, but not limited to, R. A. Walsh et al., *McGraw-Hill* 2006 *Machining and Metalworking Handbook*, McGraw-Hill, 2006, which is hereby incorporated by reference herein. After initial formation, the parts may also optionally be powder coated or plated with a surface coating (e.g., zinc or chrome) to increase durability.

Other elements required to form embodiments of the invention may be sourced from commercial vendors. Suitable bladders may be sourced from, as just one example, CONTITECH® North America (Montvale, N.J., USA). Suitable inflation control valves (e.g., lift and hoist type valves) and their associated components (e.g., pressure relief safety valves) may be sourced from, as just another example, Storm Manufacturing Group, Inc. (also known as KINGSTON® Valves) (Torrance, Calif., USA).

The bladder 115 shown in the figures is a triple convoluted air spring, which includes three interconnected chambers resembling a pair of stacked tires. The bladder 115 may, for example, comprise multiple plies of cord-reinforced rubber. Two seams between the three chambers are surrounded by rings, sometimes called "girdle hoops." Nevertheless, while the particular bladder 115 shown in the figures is of the triple convoluted type, this design choice is merely illustrative. More generally, any form of bladder or bellows capable of being inflated may be utilized in place of the illustrative bladder 115 and the results would still come within the scope of the invention. For example, instead of utilizing a triple convoluted air spring, a single convoluted air spring or a double convoluted air spring could be utilized. Moreover, in one or more alternative embodiments of the invention, a rolling lobe air spring or sleeve bag air spring could also be implemented.

As indicated above, inflation and deflation of the bladder 115 is manually controlled via the inflation control valve 125. The inflation control valve 125 may be of the type used for pneumatic lifts and hoists. More particularly, the inflation control valve 125 is preferably of the "two-state" type, allowing a compressed gas to be directed into and out of the bladder 115, as well as allowing the bladder 115 to be isolated so that it remains in a given state. In the present embodiment, the inflation control valve 125 includes a rocker that allows the user to select between inflation and deflation by pressing on one side of the rocker or the other. In use, a compressed gas such as compressed air is introduced into the inflation control valve 125 via an input port. A suitable pressure for the compressed gas may be, for example, about 105 pounds per square inch (psi). Gas released during deflation is expelled through an exhaust port. To avoid over-pressurizing the bladder 115, a pressure relief safety valve may be fitted to the inflation control valve 125.

As indicated above, the pair of lifting arms 105 acts as a lever arm in the pneumatic jack 100 when lifting the mounting block 190 and the jack pad 120. The upper mount 170 is positioned higher than the lower mount 185 when the wheels 130 of the pneumatic jack 100 are resting on a horizontal surface, placing the bladder 115 above the lower mount 185. Inflating the bladder 115 thereby applies downward pressure on the lower mount 185, causing the lower mount 185 to move downward. Subsequently, deflating the bladder 115 while it is at least partially inflated removes the downward pressure on the lower mount 185, allowing the lower mount 185 to move upward. Downward movement of the lower mount 185 lowers the proximal ends of the pair of lifting arms 105 and raises the distal ends of the pair of lifting arms 105 and the mounting block 190. Upward movement of the lower mount 185 raises the proximal ends of the pair of lifting arms 105 and lowers the distal ends of the pair of lifting arms 105 and the mounting block 190.

While the bladder 115 is being inflated and deflated, the rearward and forward stabilizing members 195, 200 maintain the lower mount 185 and the mounting block 190 at substantially constant orientations with respect to the jack body 110. The rearward stabilizing member 195 is pivotally coupled to the jack body 110 and the lower mount 185, and spans therebetween, but is coupled to the jack body 110 and the lower mount 185 at different locations from the pair of lifting arms 105. This relative geometry is maintained while the bladder 115 is inflated and deflated, maintaining the orientation of the lower mount 185 in a substantially level or slightly cocked attitude. A similar arrangement is in place for the forward stabilizing member 200. The forward stabilizing member 200 is pivotally coupled to the jack body 110 and the mounting block 190, and spans therebetween, but is coupled to the jack body 110 and the mounting block 190 at different locations from the pair of lifting arms 105. Here again, this relative geometry is maintained while the bladder 115 is inflated and deflated, maintaining the orientation of the mounting block 190 in a substantially level attitude.

Figure 8:
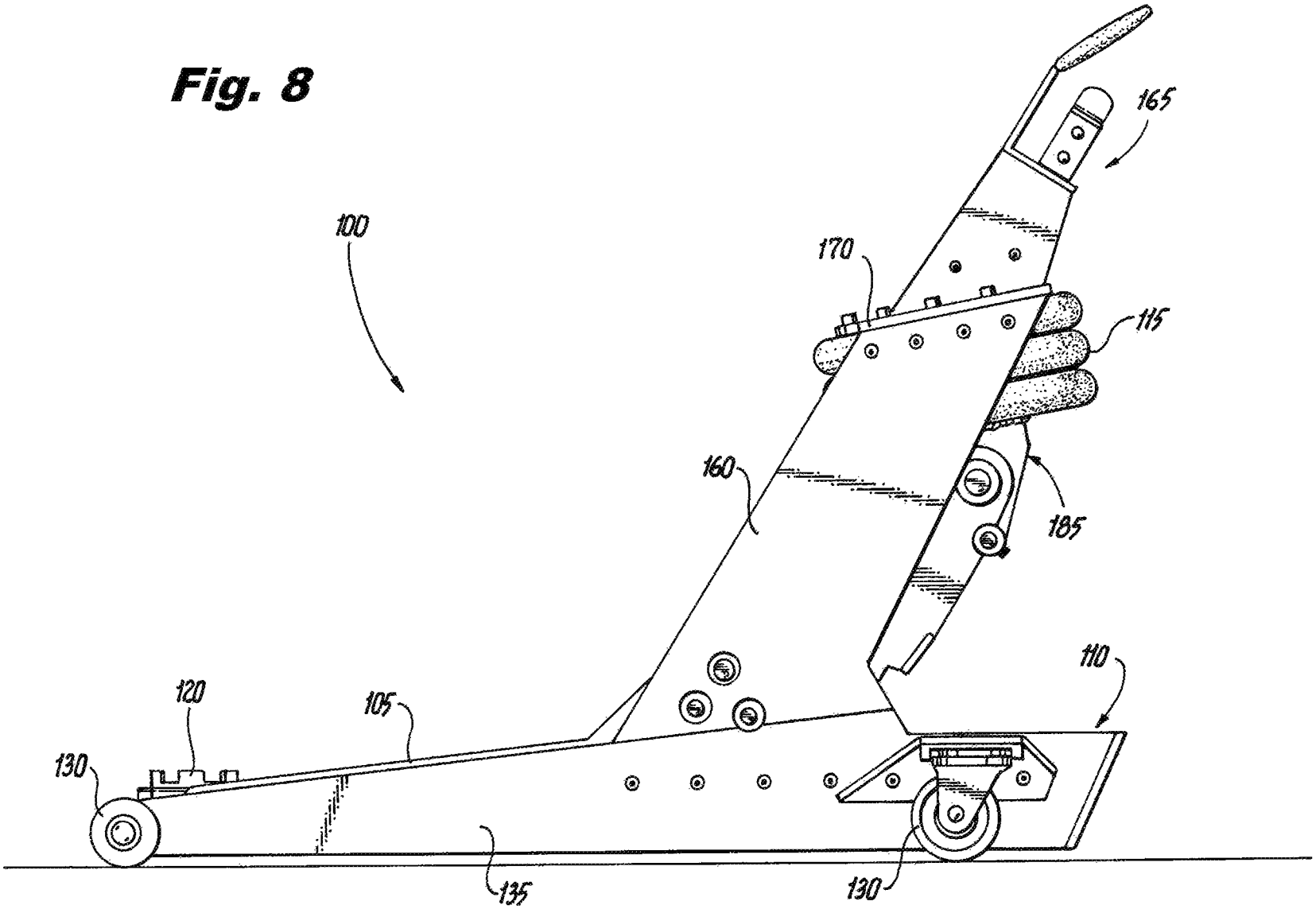
FIG. 8 shows an elevational view of the FIG. 1 pneumatic jack.
Figure 9:
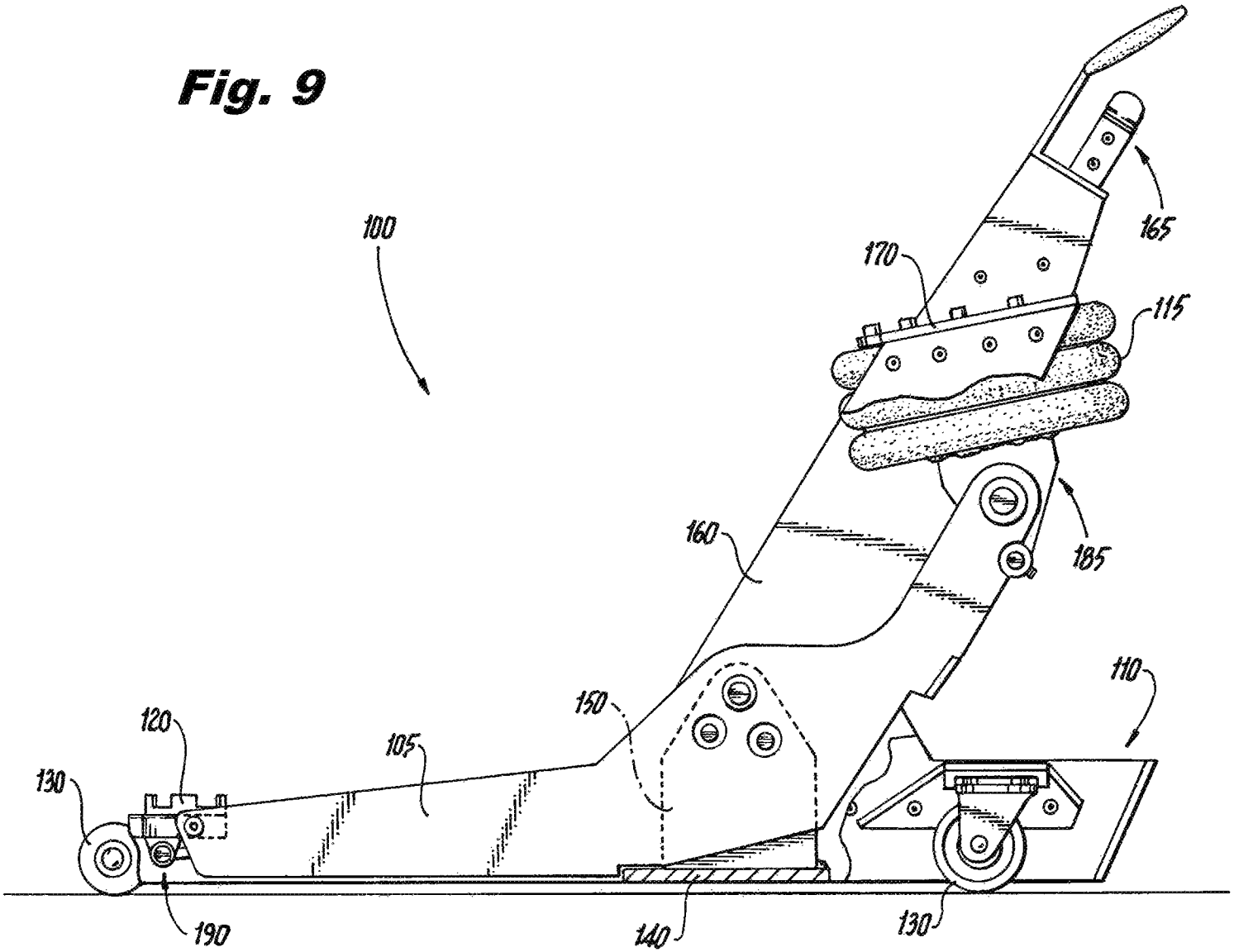
FIGS. 9-13 show broken elevational views of the FIG. 1 pneumatic jack in various lowered and raised states.
Figure 10:
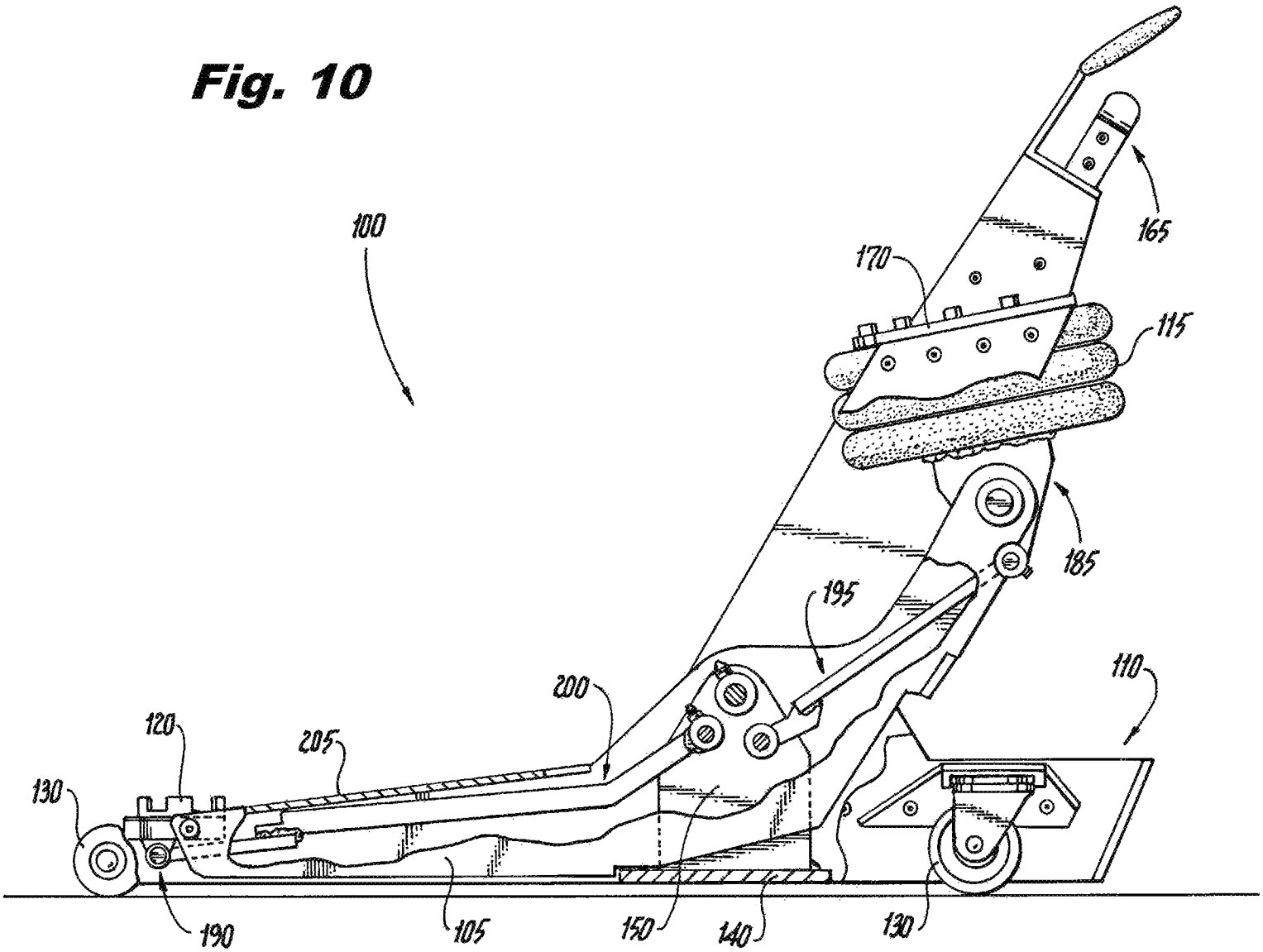
Figure 11:
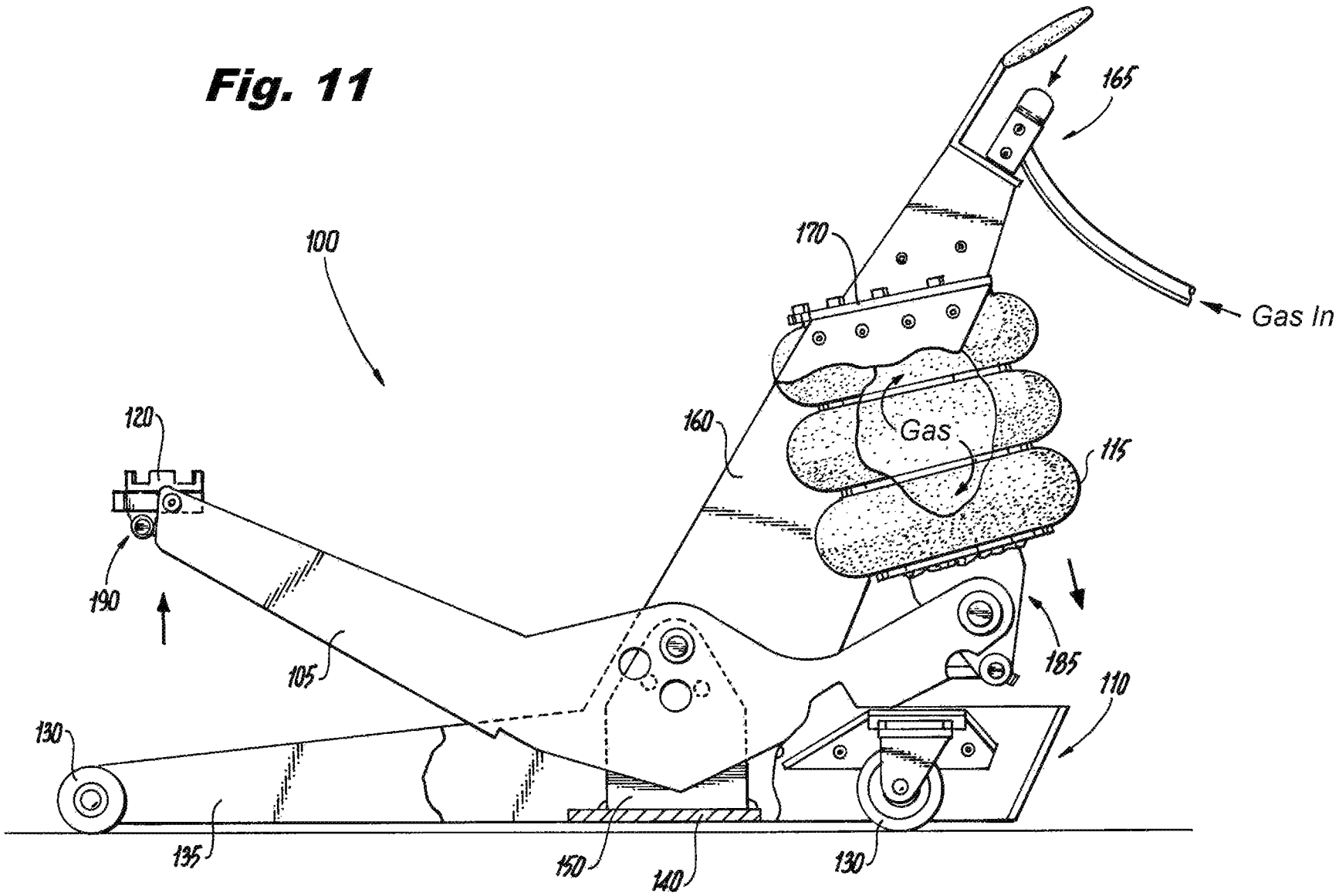
Figure 12:
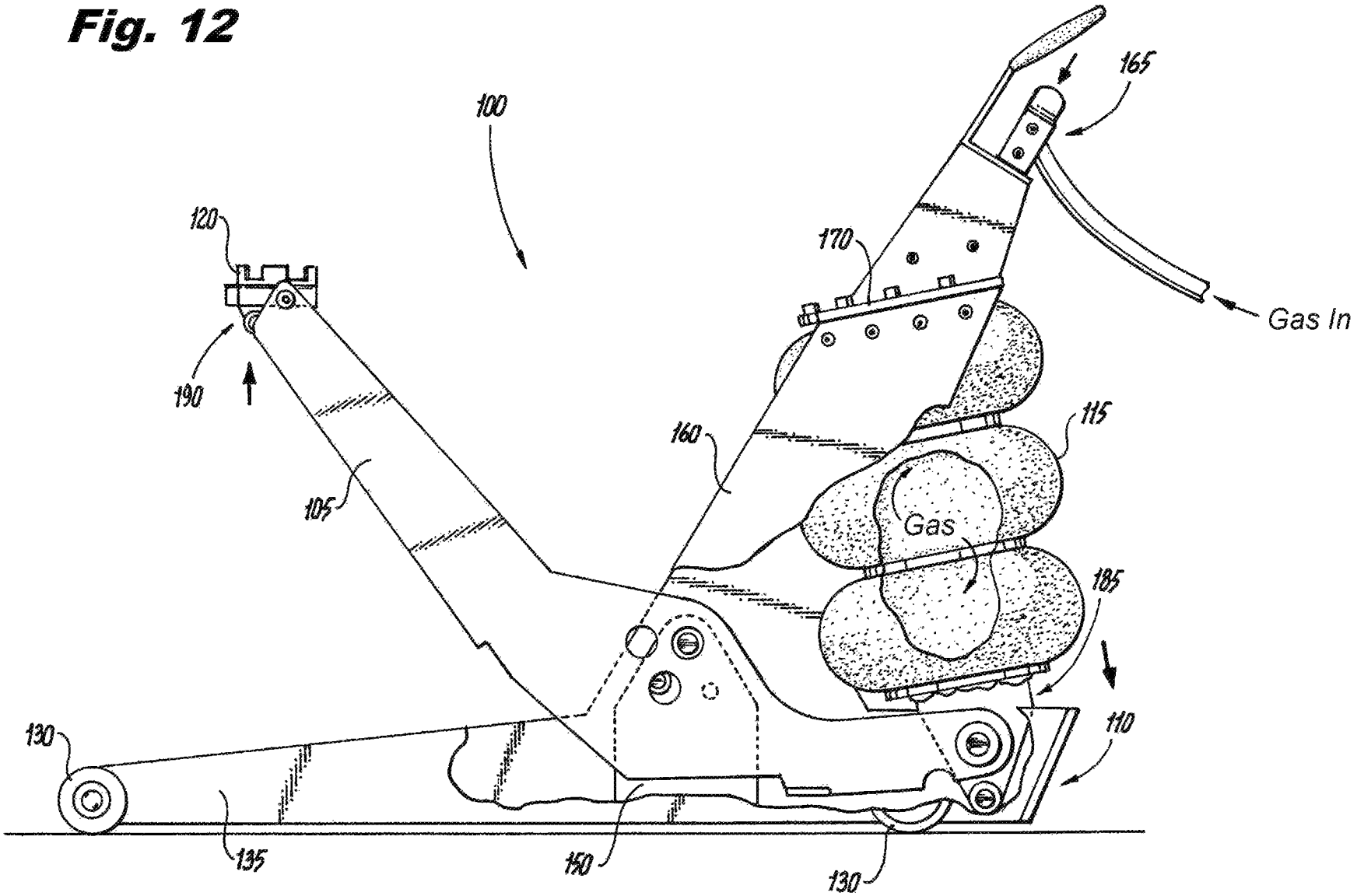
Figure 13:
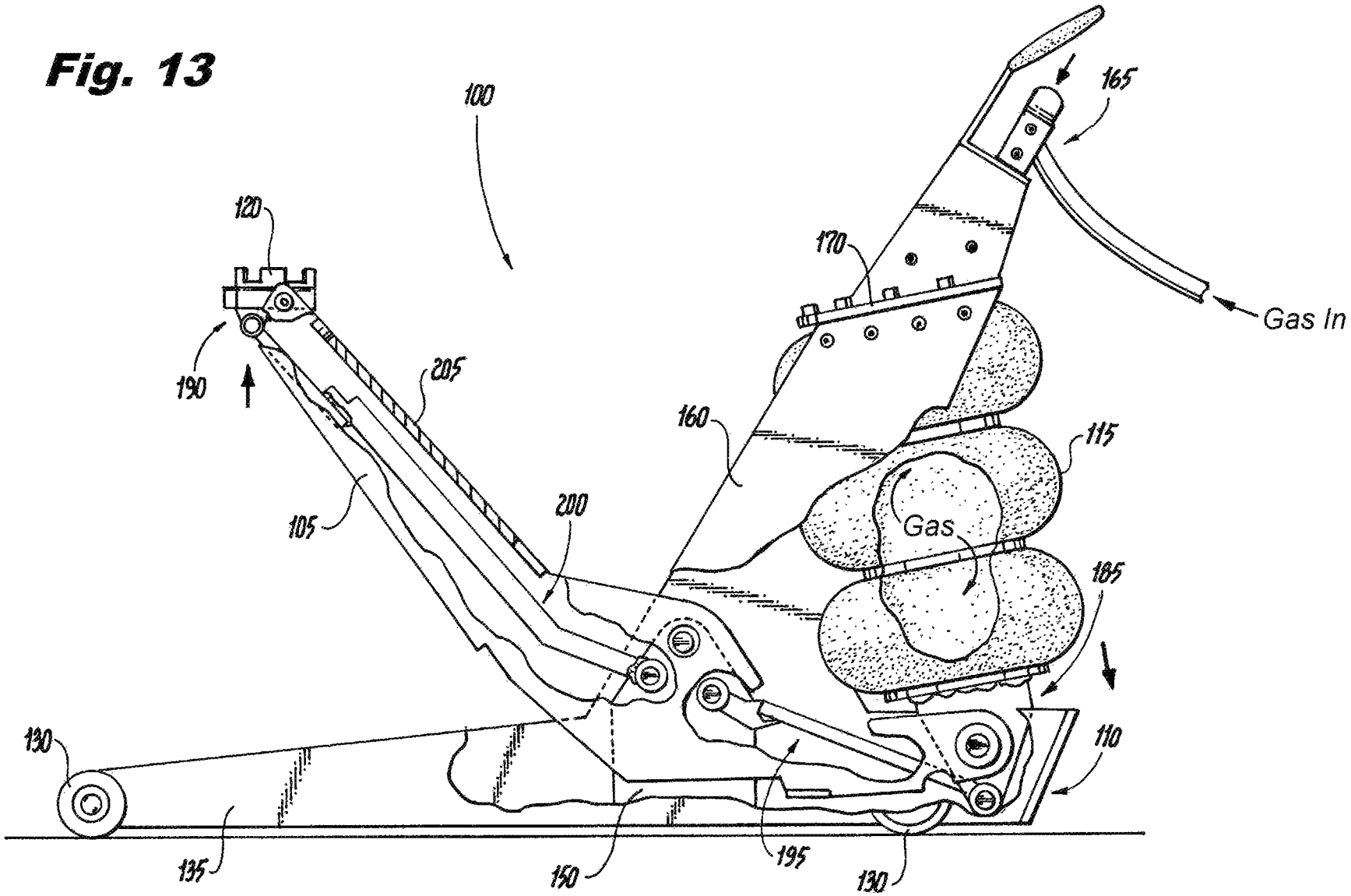

The above-described orientation-maintaining functionality may be better understood with reference to FIGS. 8-13. FIG. 8 shows an elevational view of the pneumatic jack 100, while FIGS. 9-13 show partially broken elevational views of the pneumatic jack 100 in various lowered and raised states. The cooperation of the pair of lifting arms 105 and the rearward and forward stabilizing members 195, 200 in maintaining the orientations of the lower mount 185 and the mounting block 190 is clear from these drawings.

As indicated in the Introduction, a bladder such as an air spring tends to lose its lifting force as it is inflated. Lifting force is highest at the beginning of inflation, and lowest near the end of the air spring's stroke. Lifting force may be reduced by, for example, 75% or more. Advantageously, the pneumatic jack 100, and more generally, embodiments of the present invention, may compensate somewhat for this loss in lifting force at the bladder 115. Because of the curved nature of the pair of lifting arms 105 and the positioning of their fulcrum, the ratio of the horizontal distance from the lower mount 185 to the fulcrum (i.e., the position of the first pin 210) to the horizontal distance from the mounting block 190 to the fulcrum tends to increase as the bladder 115 is inflated. This is essentially the length of the effort arm divided by the length of the resistance arm. As this ratio increases, the amount of downward force from the bladder 115 translated to upward force at the mounting block 190 also increases. Thus, as the bladder 115 naturally loses lifting force in its stroke, the corresponding loss of lifting force at the mounting block 190 is not as great. Loss of lifting force as a natural consequence of the bladder 115 expanding may also be mitigated to some extent by not requiring the bladder 115 to fully extend.

It should again be emphasized that the above-described embodiments of the invention are intended to be illustrative only. Other embodiments can use different types and arrangements of elements for implementing the described functionality. As just one example, the coupling of one object to another (whether fixedly or pivotally) can be performed in ways different from those explicitly recited herein while still obtaining the same or similar overall functionality. Alternative embodiments may, as just a few examples, utilize attachment means such as screws, bolts, rods, adhesives, brackets, pins, hooks, welds, hinges, chemical bonds, and the like to implement aspects of the invention. These numerous alternative embodiments within the scope of the appended claims will be apparent to one skilled in the relevant arts.

For example, in one or more embodiments falling within the scope of the invention, the fulcrum for the pair of lifting arms may be modified from the particular illustrative configuration described above. The positioning of the fulcrum tends to require a trade-off between lifting power and maximum lifting height. For instance, if the mechanical advantage to the bladder is enhanced, maximum lifting height tends to suffer. The particular configuration of the illustrative pneumatic jack 100 was found to provide a good compromise between lifting force and lifting height, but, again, its particular configuration is not limiting, and alternative embodiments in accordance with aspects of the invention may be configured differently.

In other embodiments, moreover, a single lifting arm may be provided for a pneumatic jack falling within the scope of the invention rather than a pair of lifting arms in the manner of pneumatic jack 100. This single lifting arm may run along the center of the alternative pneumatic jack with the stabilizing arms positioned towards the outside. Functionality would remain similar to that described above.

Figure 14:
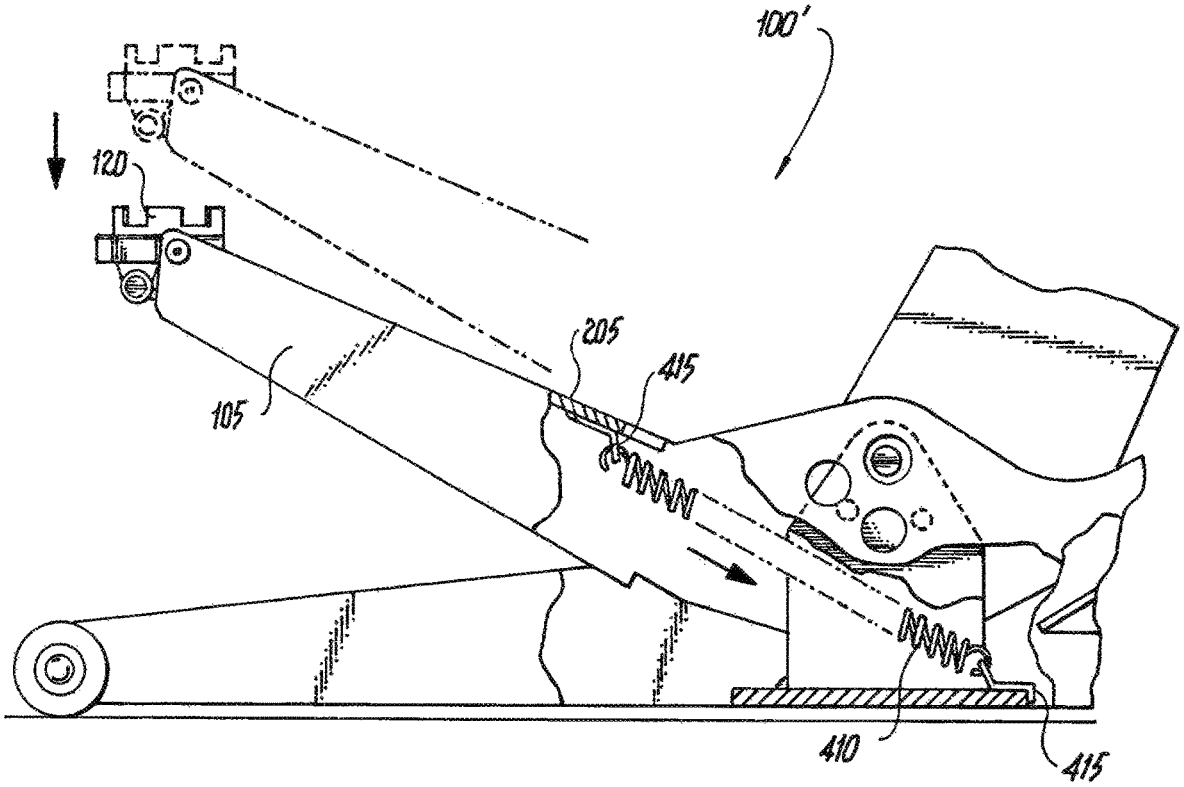
FIGS. 14 and 15 show broken elevational views of the FIG. 1 pneumatic jack with the addition of a spring.
Figure 15:
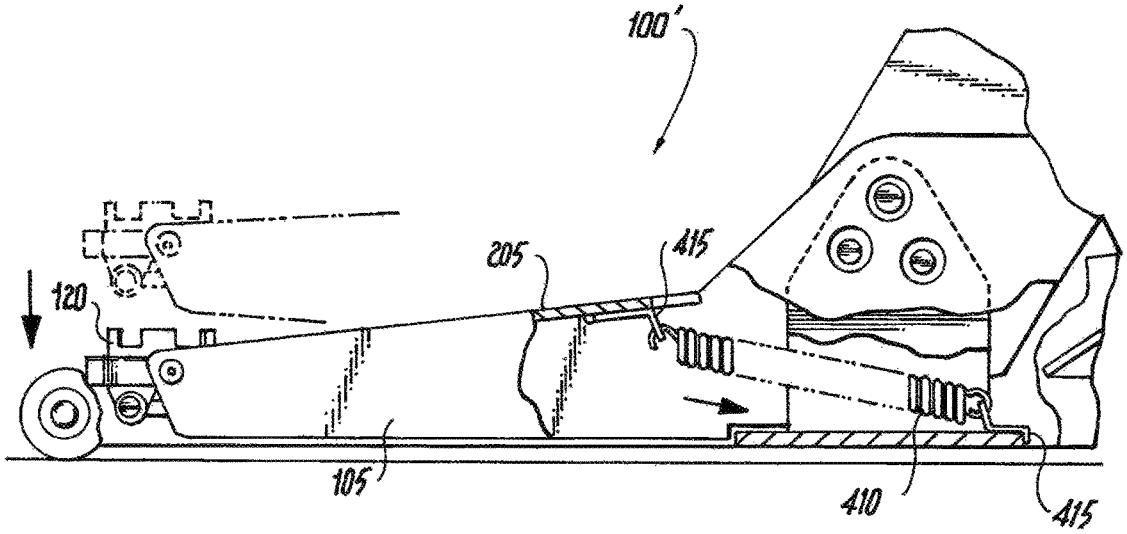

In actual reduction to practice, it was discovered that, without sufficient weight on the mounting block, a prototype of a pneumatic jack similar to the pneumatic jack 100 would not consistently fully lower when its bladder was deflated. Accordingly, alternative embodiments in accordance with aspects of the invention may also utilize one or more springs to help to achieve the fully lowered state. FIGS. 14 and 15 show partially broken elevational views of a pneumatic jack 100' that is identical to the pneumatic jack 100 except for the addition of a spring 410 and associated brackets 415. Where the pneumatic jack 100' is identical to the pneumatic jack 100, like reference numerals are utilized. In FIG. 14, the pneumatic jack 100' is near the top of its stroke, while in FIG. 15, the pneumatic jack 100' is nearly fully lowered. The spring 410 spans between the jack body 110 and the top plate 205 attached to the pair of lifting arms 105, and, in doing so, biases (i.e., urges) the pneumatic jack 100' towards its lowered state. The spring 410 thereby helps to fully lower the pneumatic jack 100' when there is little or no external weight on the jack pad 120.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in AIA 35 U.S.C. § 112(f). In particular, the use of "steps of" in the claims herein is not intended to invoke the provisions of AIA 35 U.S.C. § 112(f).

What is claimed is:

1. An apparatus comprising:

a jack body;

a lifting arm pivotally coupled to the jack body;

a lower mount pivotally coupled to a proximal end of the lifting arm;

an upper mount attached to the jack body;

a bladder disposed between the lower mount and the upper mount; and a plurality of wheels attached to the jack body;

wherein, with the plurality of wheels resting on a horizontal surface:

the upper mount is positioned higher than the lower mount;

inflating the bladder applies downward pressure on the lower mount, causing the lower mount to move downward;

deflating the bladder while it is at least partially inflated removes the downward pressure on the lower mount, allowing the lower mount to move upward;

downward movement of the lower mount lowers the proximal end of the lifting arm and raises a distal end of the lifting arm;

upward movement of the lower mount raises the proximal end of the lifting arm and lowers the distal end of the lifting arm; and a mounting block pivotally coupled to the distal end of the lifting arm;

wherein the apparatus is adapted to maintain the mounting block at a substantially constant orientation relative to the jack body while the bladder is inflated and deflated.

2. The apparatus of claim 1, wherein the jack body comprises:

a pair of lower sidewalls; and a pair of upper sidewalls projecting upward from the pair of lower sidewalls when the plurality of wheels are resting on a horizontal surface.

3. The apparatus of claim 2, further comprising a lower plate spanning between the pair of lower sidewalls.

4. The apparatus of claim 1, wherein:

the jack body further comprises a pair of internal sidewalls attached to the jack body; and the lifting arm is pivotally coupled to at least one of the pair of internal sidewalls.

5. The apparatus of claim 1, further comprising a second lifting arm substantially parallel to the lifting arm to form a pair of lifting arms.

6. The apparatus of claim 5, wherein the lower mount is at least partially disposed between the pair of lifting arms.

7. The apparatus of claim 1, wherein the lower mount defines a lower platter to which the bladder is mounted.

8. The apparatus of claim 1, wherein the upper mount defines an upper plate to which the bladder is mounted.

9. The apparatus of claim 1, further comprising a valve operative to control inflation and deflation of the bladder.

10. The apparatus of claim 1, wherein the bladder comprises an air spring.

11. The apparatus of claim 1, wherein at least one of the plurality of wheels comprises a caster.

12. The apparatus of claim 1, further comprising a second lifting arm substantially parallel to the lifting arm to form a pair of lifting arms, wherein the mounting block is at least partially disposed between the pair of lifting arms.

13. The apparatus of claim 1, further comprising a jack pad mounted to the mounting block.

14. The apparatus of claim 1, further comprising a forward stabilizing member pivotally coupled to the jack body and the mounting block, and spanning therebetween.

15. The apparatus of claim 14, wherein:

the forward stabilizing member is pivotally coupled to the jack body at a different location on the jack body from the lifting arm; and the forward stabilizing member is pivotally coupled to the mounting block at a different location on the mounting block from the lifting arm.

16. The apparatus of claim 1, further comprising a rearward stabilizing member pivotally coupled to the jack body and the lower mount, and spanning therebetween.

17. The apparatus of claim 16, wherein:

the rearward stabilizing member is pivotally coupled to the jack body at a different location on the jack body from the lifting arm; and the rearward stabilizing member is pivotally coupled to the lower mount at a different location on the lower mount from the lifting arm.

18. The apparatus of claim 1, wherein the apparatus is adapted to maintain the lower mount at a substantially constant orientation relative to the jack body while the bladder is inflated and deflated.

* * * * *